US007927069B2

(12) United States Patent
Erickson et al.

(10) Patent No.: US 7,927,069 B2
(45) Date of Patent: Apr. 19, 2011

(54) HOOP SEAL WITH PARTIAL SLOT GEOMETRY

(75) Inventors: Robert E. Erickson, Storrs, CT (US); Robert A. Charbonneau, Meriden, CT (US); Brian J. Schwartz, West Hartford, CT (US); Trevor S. Smith, East Hampton, CT (US)

(73) Assignee: United Technologies Corporation, Hartford, CT (US)

( * ) Notice: Subject to any disclaimer, the term of this patent is extended or adjusted under 35 U.S.C. 154(b) by 832 days.

(21) Appl. No.: 11/598,486

(22) Filed: Nov. 13, 2006

(65) Prior Publication Data

US 2008/0112811 A1 May 15, 2008

(51) Int. Cl.
*F01D 11/02* (2006.01)
*F04D 29/34* (2006.01)

(52) U.S. Cl. ..... 415/173.7; 415/174.5; 416/220 R

(58) Field of Classification Search ..... 415/171.1, 415/174.5, 173.7; 416/219 R, 220 R
See application file for complete search history.

(56) References Cited

U.S. PATENT DOCUMENTS

| | | | | |
|---|---|---|---|---|
| 3,761,200 | A | 9/1973 | Gardiner | |
| 5,601,404 | A * | 2/1997 | Collins | 415/173.7 |
| 6,189,891 | B1 | 2/2001 | Tomita et al. | |
| 6,190,131 | B1 * | 2/2001 | Deallenbach | 416/144 |
| 2002/0081205 | A1 * | 6/2002 | Wong | 416/219 R |

* cited by examiner

*Primary Examiner* — Edward Look
*Assistant Examiner* — Dwayne J White
(74) *Attorney, Agent, or Firm* — Carlson, Gaskey & Olds, P.C.

(57) ABSTRACT

A rotor blade assembly includes a slot for mounting a rotor blade that extends partially through a rotor disk and a continuous uninterrupted hoop seal that extends about the circumference of the rotor disk. The rotor disk includes an integrally formed seal that includes at least one knife edge disposed concentrically about the rotor disk. The slot receives a root portion of a rotor blade but does not extend through the seal. As the seal remains an uninterrupted full hoop about the circumference of the rotor disk, additional rigidity and strength are realized. The increased rigidity and strength provided by the full hoop structure provides for the reduction in material and physical dimensions without compromising desired performance of the seal.

16 Claims, 5 Drawing Sheets

HOOP SEAL WITH PARTIAL SLOT GEOMETRY

BACKGROUND OF THE INVENTION

This invention generally relates to a bladed rotor assembly seal and a method of assembling a bladed rotor assembly seal.

Turbine engines include rotor spools comprising one or several rotor disks. Fluid seals are included on the rotor disks for sealing against fixed elements of the turbine engine. The seals separate a lower pressure gas path air from higher pressure, cooling air. Each of the rotor blades includes a blade portion and a root portion that is mounted within the rotor disk. The root portion is received within a slot within the rotor disk to secure and position the rotor blade.

The slots for each of the rotor blades are formed by a secondary machining operation to provide the desired fit between each of the rotor blades and the rotor disk. The slot extends entirely through the rotor disk including the seal. The resulting seal on the rotor disk is therefore interrupted at each position where a rotor blade slot is formed. Each rotor blade is then formed to include a surface that matches the seal profile. Because each rotor blade is matched to the seal profile, the complex seal profile is manufactured once for the rotor disk and again for each of the rotor disks. Therefore, the interfiting of each rotor blade creates a seal that comprises rotor disk portions and rotor blade portions segmented and interrupted about the circumference of the rotor disk.

The interface between each of the rotor blades and the rotor disk is held to close tolerances to provide the desired seal profile through each rotor blade and the rotor disk. As with any mating interface, some undesirable gaps or spacing will occur between a rotor blade and the rotor disk. Gaps between the rotor disk and the rotor blade can result in less than desired seal performance.

SUMMARY OF THE INVENTION

An example rotor blade assembly includes a slot for mounting an example rotor blade that extends partially through a rotor disk and a continuous uninterrupted hoop seal that extends about the circumference of the rotor disk.

The example rotor disk includes the seal having at least one seal edge disposed concentrically about the rotor disk that correspond to abradable structures for sealing and containing air flow about the rotor disk. The example seal is an integral part of the rotor disk.

The example slot receives a root portion of a rotor blade but does not extend through the seal. As the seal remains an uninterrupted full hoop about the circumference of the rotor disk, additional rigidity and strength are realized as compared to conventional segmented seals that utilize portions of a rotor blade to complete the seal. The increased rigidity and strength provided by the full hoop structure provides for the reduction in material and physical dimensions without compromising desired performance of the seal.

These and other features of the present invention can be best understood from the following specification and drawings, the following of which is a brief description.

DETAILED DESCRIPTION OF THE PREFERRED EMBODIMENT

Figure 1:
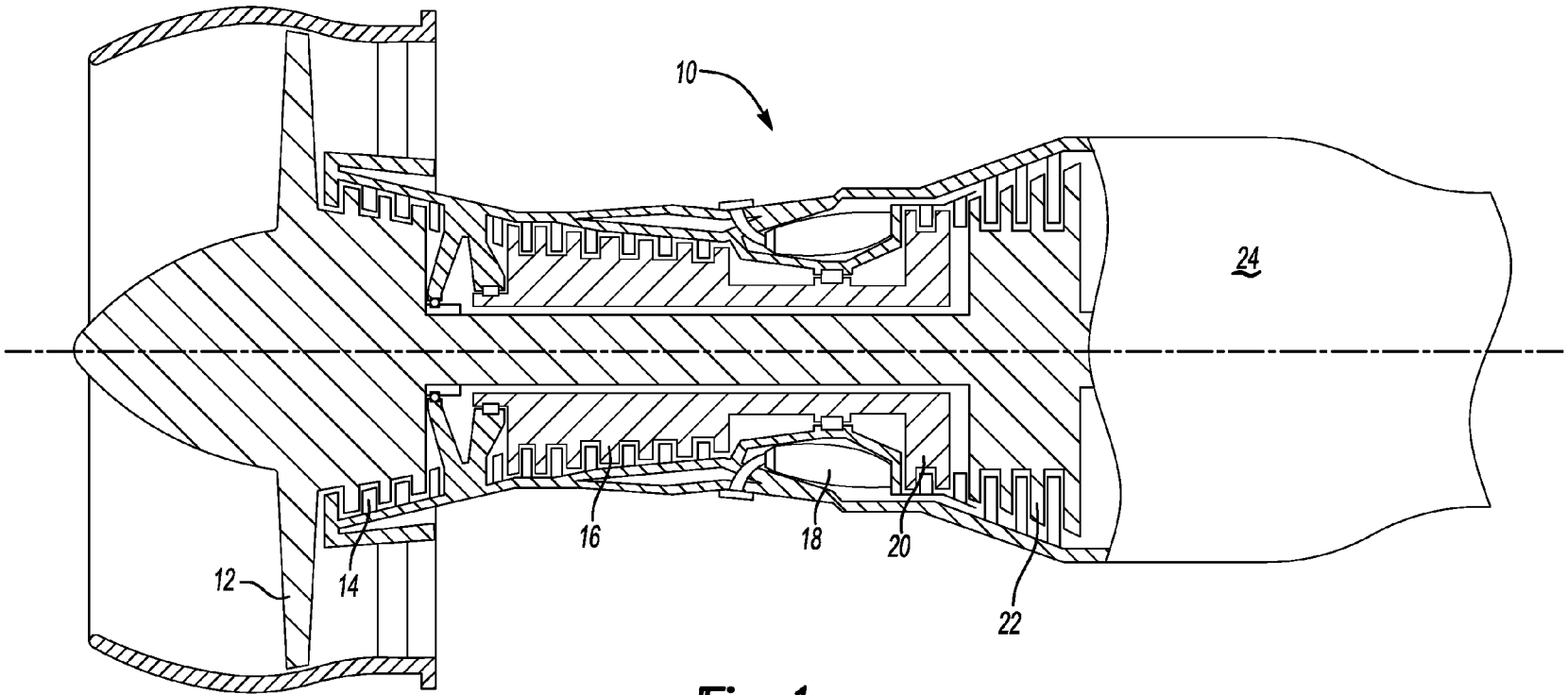
FIG. 1 is a simplified schematic view of an example turbine engine.

FIG. 1 is a simplified schematic view of an example turbine engine 10 that includes a fan 12 for pulling air into the turbine engine 10. The air pulled into the turbine engine 10 is drawn through a low pressure compressor 14 and a high pressure compressor 16. Compressed air is fed to a combustor 18, mixed with fuel and ignited to produce a high velocity gas stream. The high velocity gas stream drives a high pressure turbine 20 and a low pressure turbine 22 and is exhausted through an exhaust nozzle 24.

The high pressure turbine 20 and low pressure turbine 22 comprise a plurality of bladed rotor assemblies that each includes a plurality of blades mounted about an outer rim of a rotor disk. Between the bladed rotor assemblies are fixed structures and seals that control and contain the flow of exhaust gases and compressed air to provide the desired engine performance.

Figure 2:
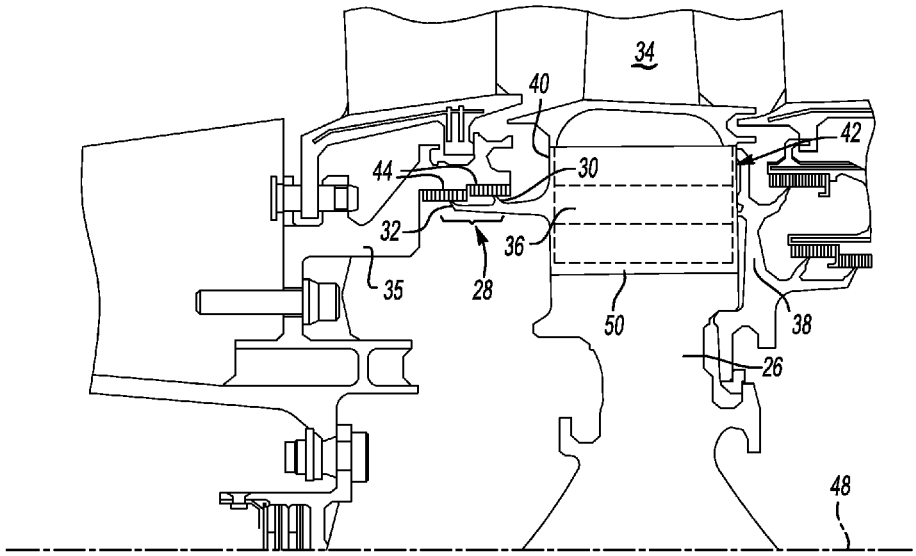
FIG. 2 is a schematic view of an example rotor disk assembly.

Referring to FIG. 2, an example rotor disk 26 includes a seal 28 that is disposed proximate a fixed structure 35. The fixed structure 35 supports abradable honeycomb material 44 that correspond to knife edges 30 and 32 of the seal 28. The knife edges 30 and 32 are disposed concentrically with each other to provide the desired sealing of air flow about the rotor disk 26. During operation, the seal edges 30 and 32 interact with the abradable honeycomb material 44 to provide the desired seal. The seal 28 rotates with the rotor disk 26 while the abradable honeycomb material 44 remains stationary.

The bladed rotor disk 26 provides for the support of a plurality of rotor blades 34. Each of the rotor blades 34 includes a root portion 36 that is received within an axial slot 50 of the rotor disk 26. The slot 50 extends axially through the rotor disk 26, but not the seal 28. Because the slot 50 does not extend through the seal 28, the seal 28 is a continuous uninterrupted hoop structure that extends about the circumference of the rotor disk 26.

Figure 3:
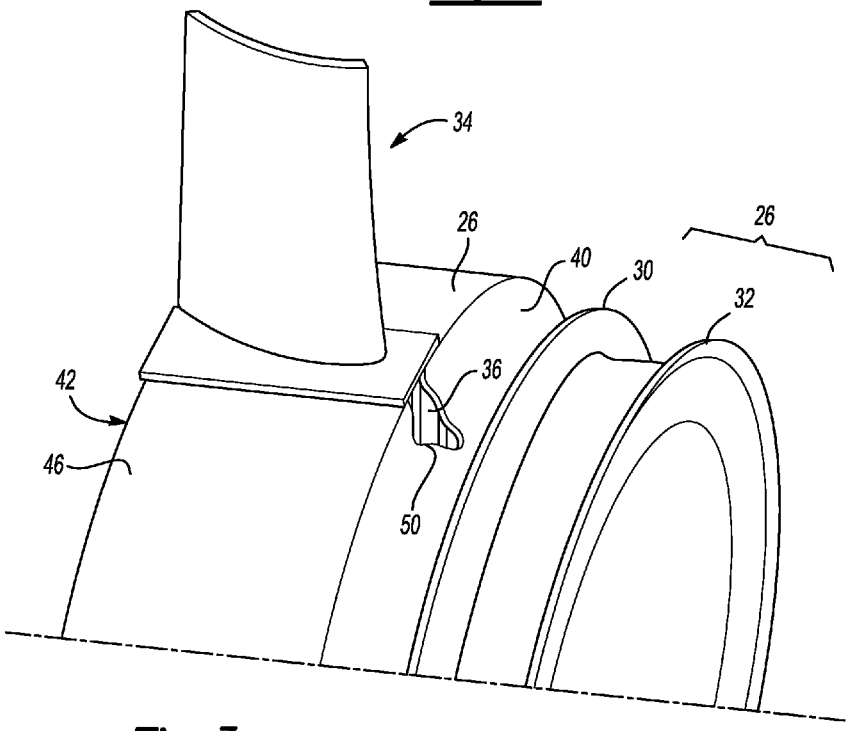
FIG. 3 is a perspective view of a portion of the example rotor disk assembly.

Referring to FIG. 3, the knife edges 30, 32 remain uninterrupted because the slot 50 extends only partially through the rotor disk 26. The uninterrupted structure of the seal 28 provides increased strength and improved leakage restriction when compared to interrupted and segmented seals 28.

The slot 50 for receiving the rotor portion 36 of the example rotor blade 34 extends from a second side 42 of the rotor disk to a first side 40. Accordingly, a portion of the front side 42 opens into the slot 50. However, the slot 50 does not extend into the seal 28. The root portion 36 of the example rotor blade 34 is visible in the example slot 50 as illustrated but does not extend into the seal 28. The root portion 36 includes a profile shaped to match a portion of the first side 40 of the rotor disk 26 that does not include the seal 28. Because the seal profile is not required to be reproduced in the root portion 36 of the rotor blade 34, manufacturing of the rotor blade 34 is simplified.

Figure 4:
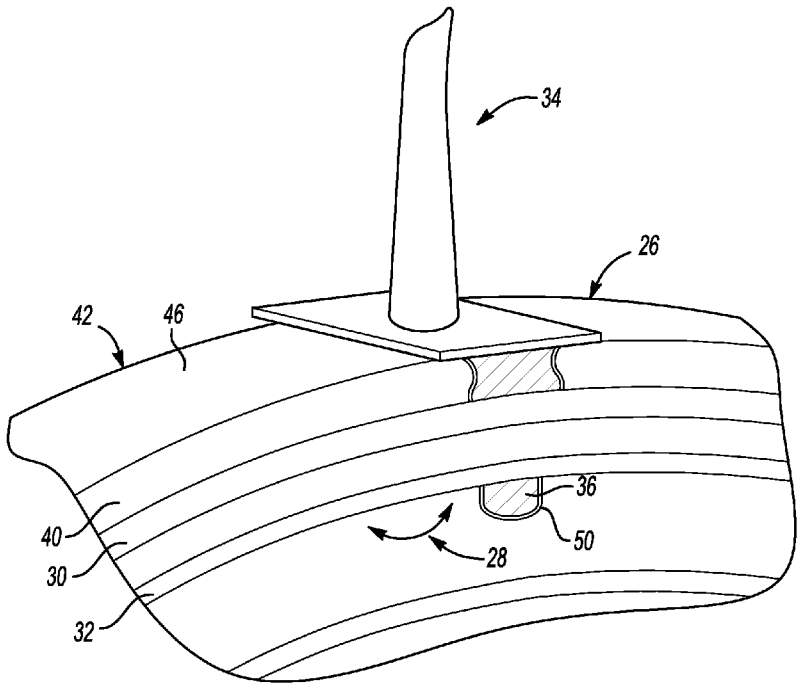
FIG. 4 is another perspective view of a portion of the example rotor disk assembly.

Referring to FIG. 4, the example rotor disk 26 includes a disk rim 46 that is disposed between the first side 40 and the second side 42. The disk rim 46 is that perimeter surface that is substantially transverse and between the first and second sides 40, 42. The first side 40 includes the seal 28. The slot 50 extends downward radially from the disk rim 46 to a point below the seal 28 such that a portion of the example root portion 36 is exposed through the first side 40. However, the root portion 36 does not extend axially through the seal 28.

Figure 5:
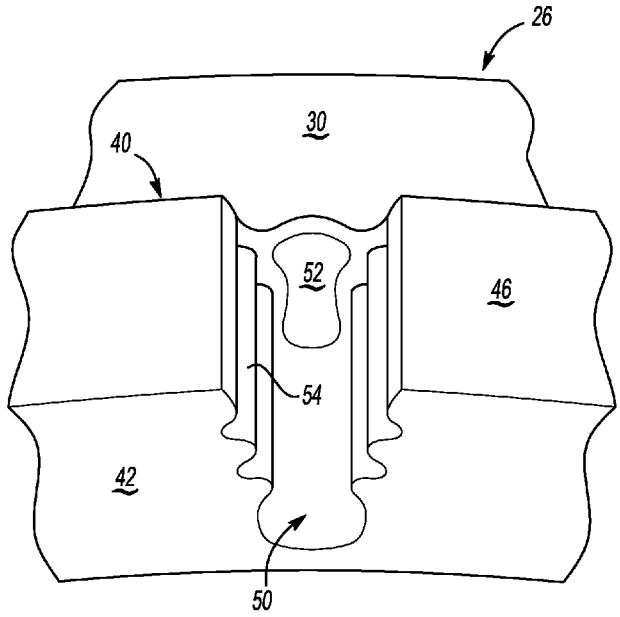
FIG. 5 is a view of an example slot within the example rotor disk assembly.

Referring to FIG. 5, the example slot 50 is shown without the rotor blade 34 installed and extends from an opening exposed on the second side 42 toward the first side 40 of the rotor disk 26. The example slot 50 includes a partial opening 52 on the first side 40 that does not break through the continuous seal 28. The example slot 50 includes an inner profile 54 that provides for positioning and securing the rotor blade 34 in a desired position during engine operation.

Figure 6:
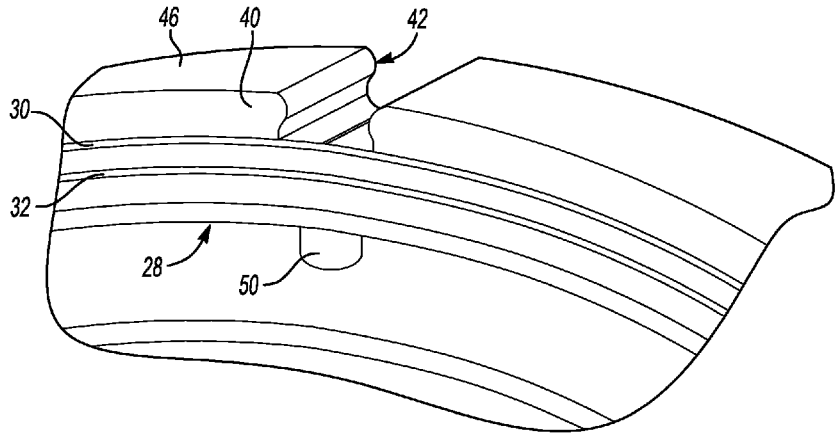
FIG. 6 is a front view of the example slot within the example rotor disk assembly.

Referring to FIG. 6, the slot 50 is illustrated from the first side 40 of the example rotor disk 26. The seal 28 remains as an integral, continuous and uninterrupted structure disposed on the first side 40. As the seal 28 remains an uninterrupted full hoop about the circumference of the rotor disk 26, additional rigidity, strength and improved leakage restriction are realized as compared to conventional segmented seals that utilize portions of a rotor blade to complete the seal. The increased-rigidity and strength provided by the full hoop structure provides for the reduction in material and physical dimensions without sacrificing the desired performance of the seal 28.

Fabrication of the rotor disk assembly includes the steps of forming the rotor disk 26 to include the first side 40 and the second side 42. The forming step further includes forming the rotor disk 26 to include the uninterrupted concentric seal 28 on the first side 40. The example concentric seal 28 includes the first seal edge 30 and the second seal edge 32. Although the example concentric seal 28 includes two knife edges, the number of knife edges may vary depending on the pressure ratio between the combustion gases and the cooling air.

The rotor disk 26 is formed utilizing materials such as powdered Nickel that provide desired strength and durability characteristics for the environment encountered during engine operation. The formed rotor disk 26 includes the disk rim 46 that is the periphery of the rotor disk 26 and that is disposed between the first side 40 and the second side.

The slot 50 is cut along the rotor disk 26 periphery and is open to the second side 42 opposite the seal 28. The slot 50 is cut from the second side 42 toward the first side 40, to a point desired to provide a desired fit of the rotor blade 34. However, no portion of the slot 50 extends entirely through the seal 28. Some portions of the slot 50 may extend into portions of the seal 28, but no portion extends through any of the seal edges 30, 32.

Figure 7:
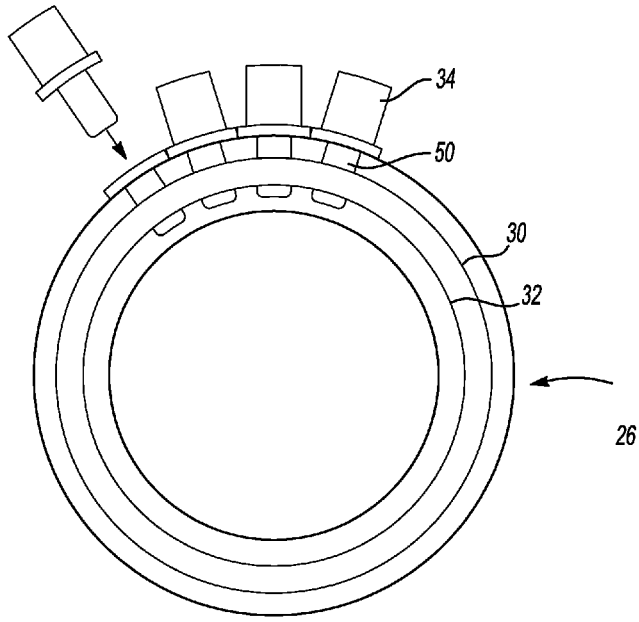
FIG. 7 is a schematic front view of the example rotor disk assembly.

Referring to FIG. 7 with continuing references to FIG. 6, the knife edges 30 and 32 remain a single uninterrupted continuous hoop concentric about the rotor disk 26. The slot 50 is fabricated utilizing methods as are known for example with the use of a cutting tool. The example slot 50 is open along the disk rim 46. Although a single slot 50 is illustrated and discussed, a plurality of slots 50 are formed into the rotor disk 26 as are need to support the desired number of rotor blades 34.

Figure 8:
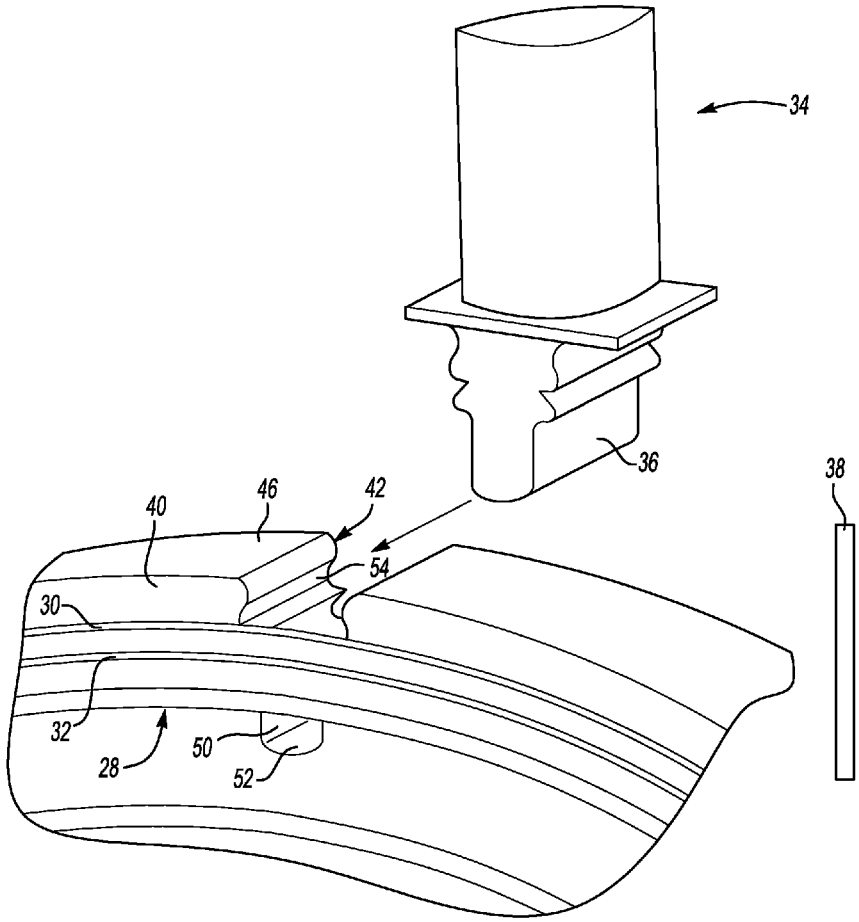
FIG. 8 is a schematic view of assembly steps for the example rotor disk assembly.

Referring to FIG. 8, the slot 50 is formed to include the complimentary-shaped inner profile 54 that receives the rotor blade 34 from the second side 42. Each rotor blade 34 is slid from the second side 42 into the slot 50 toward the first side 40. As the seal 28 remains an integral portion of the rotor disk 26 the rotor blade 34 is pushed forward to abut a rear surface of the seal 28. Abutting contact between the rotor blade 34 and the seal 28 provides an axial stop for maintaining the rotor blade 34 within the rotor disk 26. A cover plate 38 is attached to the second side 42 of the rotor disk 26 to secure the rotor blade 34 within the rotor disk 26. The integrally formed continuous seal 28 thereby provides for the elimination of an additional cover or mounting device for maintaining the rotor blade 34 within the rotor disk 26.

Accordingly, as the slot 50 extends only partially through the rotor disk 26, the seal 28 includes complete uninterrupted hoop knife edges 30 and 32. The seal 28 may then be fabricated as thinner structures due to the increased strength and durability provided by the continuous hoop. The continuous seal 28 thereby provides improved leakage restriction performance with smoother, lighter and thinner knife edges that are not cantilevered in short sections about the rotor disk and from each of a plurality of rotor blades.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A bladed rotor assembly comprising;

a rotor disk defining a disk rim and having a rotor blade mounted to the disk rim, the disk rim defining an outer most periphery of the rotor disk;

a seal disposed on a first side of the rotor disk radially inward of the outermost periphery of the disk rim and including a continuous circumferential surface; and a slot open on a second side that includes a bottom surface with the entire seal further disposed radially outward of the bottom surface, the slot extending partially toward the first side such that the slot does not extend through the seal.

2. The bladed rotor assembly as recited in claim 1, wherein each of the plurality of rotor blades comprise a root portion received within the slot.

3. The bladed rotor assembly as recited in claim 2, including a cover plate attached to the second side over the open slot to secure the rotor blade within the slot.

4. The bladed rotor assembly as recited in claim 2, wherein the root portion of the rotor blade includes a forward surface that matches a profile of the second side of the rotor disk.

5. The bladed rotor assembly as recited in claim 1, wherein the seal comprises at least one concentric knife edges.

6. The bladed rotor assembly as recited in claim 1, wherein the slot is disposed in the disk rim.

7. The bladed rotor assembly as recited in claim 1, wherein the seal comprises a profile defined within the first surface.

8. The bladed rotor assembly as recited in claim 1, wherein the seal is comprised between a bottom surface radially outward of the bottom surface of the slot and an upper surface radially inward of the outer periphery of the disk rim.

9. A method of fabricating a bladed rotor assembly comprising the steps of:

a) forming a rotor disk including a first side, a second side and an outer peripheral surface;

b) forming an uninterrupted concentric seal on a first side of the rotor disk radially inward of the outer peripheral surface a first distance from the outer peripheral surface;

c) forming a slot from the second side within the outer peripheral surface that includes a bottom surface spaced from the outer peripheral surface a second distance greater than the first distance and that extends at least partially through the rotor disk toward the first side such that the entire seal is disposed radially outward of the bottom surface and is not interrupted by the formed slot; and d) securing a rotor blade within the slot.

10. The method as recited in claim 9, wherein step c. comprises cutting a slot from the second side partially through to the first side of the rotor disk.

11. The method as recited in claim 10, wherein the rotor disk includes a disk rim between the first side and the second side and step c comprises cutting the slot in the disk rim.

12. The method as recited in claim 9, wherein step b comprises forming at least one knife edge concentric with the rotor disk and extending from the first side of the rotor disk.

13. The method as recited in claim 9, including the step of forming a side of the rotor blade to match the first side of the rotor disk.

14. The method as recited in claim 9, wherein step d. comprises axially holding the rotor blade within the slot with the seal on the first side.

15. The method as recited in claim 14, wherein step d. comprise attaching a cover plate to the second side of the rotor disk for securing the rotor blade within the slot.

16. The method as recited in claim 9, wherein the seal is comprises a top surface spaced a first distance from the outer peripheral surface and a bottom surface spaced radially outward of the bottom surface of the slot.

* * * * *